US005647587A

United States Patent [19]

Smart et al.

[11] Patent Number: 5,647,587

[45] Date of Patent: Jul. 15, 1997

[54] DOCUMENT SET ACCUMULATOR HAVING GUIDE ELEMENTS WITH COMPRESSIBLE O-RINGS FOR TOOL-LESS ADJUSTMENT

[75] Inventors: Michael Smart, Easton; Mark Ricker, Tatamy, both of Pa.; Leonard Neifert, Apex, N.C.

[73] Assignee: Bell & Howell Phillipsburg Company, Allentown, Pa.

[21] Appl. No.: 544,806

[22] Filed: Oct. 18, 1995

[51] Int. Cl.[6] ..... B65H 43/04

[52] U.S. Cl. ..... 271/223; 271/184; 271/198; 271/212; 403/365

[58] Field of Search ..... 271/198, 212, 271/223, 184–186; 403/326, 365, 372

[56] References Cited

U.S. PATENT DOCUMENTS

| | | | |
|---|---|---|---|
| 2,177,924 | 10/1939 | Buckwalter | 403/365 |
| 2,919,940 | 1/1960 | Anderson | 403/365 |
| 3,262,666 | 7/1966 | Solum | 403/372 X |
| 3,637,269 | 1/1972 | Lantry | 403/365 X |
| 3,861,815 | 1/1975 | Landaeus | 403/372 X |
| 3,995,967 | 12/1976 | Haller | 403/372 X |
| 4,445,257 | 5/1984 | Delhaes | 403/372 X |
| 4,550,904 | 11/1985 | Union | 271/198 |
| 4,640,506 | 2/1987 | Luperti et al. | 271/212 |
| 4,773,641 | 9/1988 | Metz | 403/372 X |
| 4,805,891 | 2/1989 | Luperti et al. | 271/212 |
| 5,147,092 | 9/1992 | Driscoll et al. | 271/212 X |
| 5,342,038 | 8/1994 | Suter | 271/198 |

FOREIGN PATENT DOCUMENTS

| | | | |
|---|---|---|---|
| 624354 | 2/1963 | Belgium | 403/372 |
| 598519 | 12/1925 | France | 403/365 |
| 1023532 | 3/1953 | France | 403/372 |

*Primary Examiner*—Boris Milef

*Attorney, Agent, or Firm*—Millen, White, Zelano, & Branigan, P.C.

[57] ABSTRACT

A document accumulator capable of tool-less adjustment to accomodate a plurality of paper sizes includes a shaft laterally oriented across a paper path through the accumulator, a guide element mounted to the shaft for contacting and guiding documents transported through the accumulator, a connector for slidably connecting the guide element to the shaft, and a compressible O-ring inserted between the shaft and the connector for imparting friction therebetween, whereby the guide element can be translated along the shaft without the use of a tool.

5 Claims, 3 Drawing Sheets

DOCUMENT SET ACCUMULATOR HAVING GUIDE ELEMENTS WITH COMPRESSIBLE O-RINGS FOR TOOL-LESS ADJUSTMENT

BACKGROUND OF THE INVENTION

1. Field of the Invention

The invention relates in general to insertion machines for compiling sets of documents and inserting such sets into envelopes, and in particular to an accumulator device having paper guide mechanisms capable of tool-less adjustment.

2. Related Art

Ramp accumulators are well-known for accumulating sets of documents from a stream of documents fed seriatim thereto. Such accumulators typically include at least two driven belts which engage a document at its upper and lower surface, respectively, shaft-mounted pulleys for directing and driving the belts, two side guides which engage and guide the edges of documents being transported by the belts, a ramp for directing the document upward onto the top of a stack of accumulated documents ("over-accumulation") or downward under a stack of documents ("under-accumulation"), and a sheet-restraining means for preventing the stacked documents from being fed by the belts until all sheets for a particular set have been accumulated.

Accumulators of the prior art are typically designed to handle a single paper size. That is, variables such as the lateral positioning of the belts, the lateral and longitudinal positioning of the ramps, and the distance between the side guides have been either permanantly set or have been adjustable only through time-consuming procedures involving, e.g., the loosening and tightening of various set screws.

OBJECTS AND SUMMARY OF THE INVENTION

It is therefore an object of the invention to provide an accumulator which is quickly configurable for various paper sizes without the use of tools.

The invention according to a preferred embodiment comprises an accumulator capable of tool-less adjustment to accomodate a plurality of paper sizes, the accumulator including a shaft laterally oriented across a paper path, a guide element mounted to the shaft for contacting and guiding documents transported through the accumulator, a connector for slidably connecting the guide element to the shaft, and a compressible O-ring inserted between the shaft and the connector for imparting friction therebetween, whereby the guide element can be translated along the shaft without the use of a tool.

BRIEF DESCRIPTION OF THE DRAWINGS

The foregoing and other objects, features, and advantages of the invention will be apparent from the following more particular description of preferred embodiments as illustrated in the accompanying drawings, in which reference characters refer to the same parts throughout the various views. The drawings are not necessarily to scale, emphasis instead being placed upon illustrating principles of the invention.

DETAILED DESCRIPTION

Figure 1:
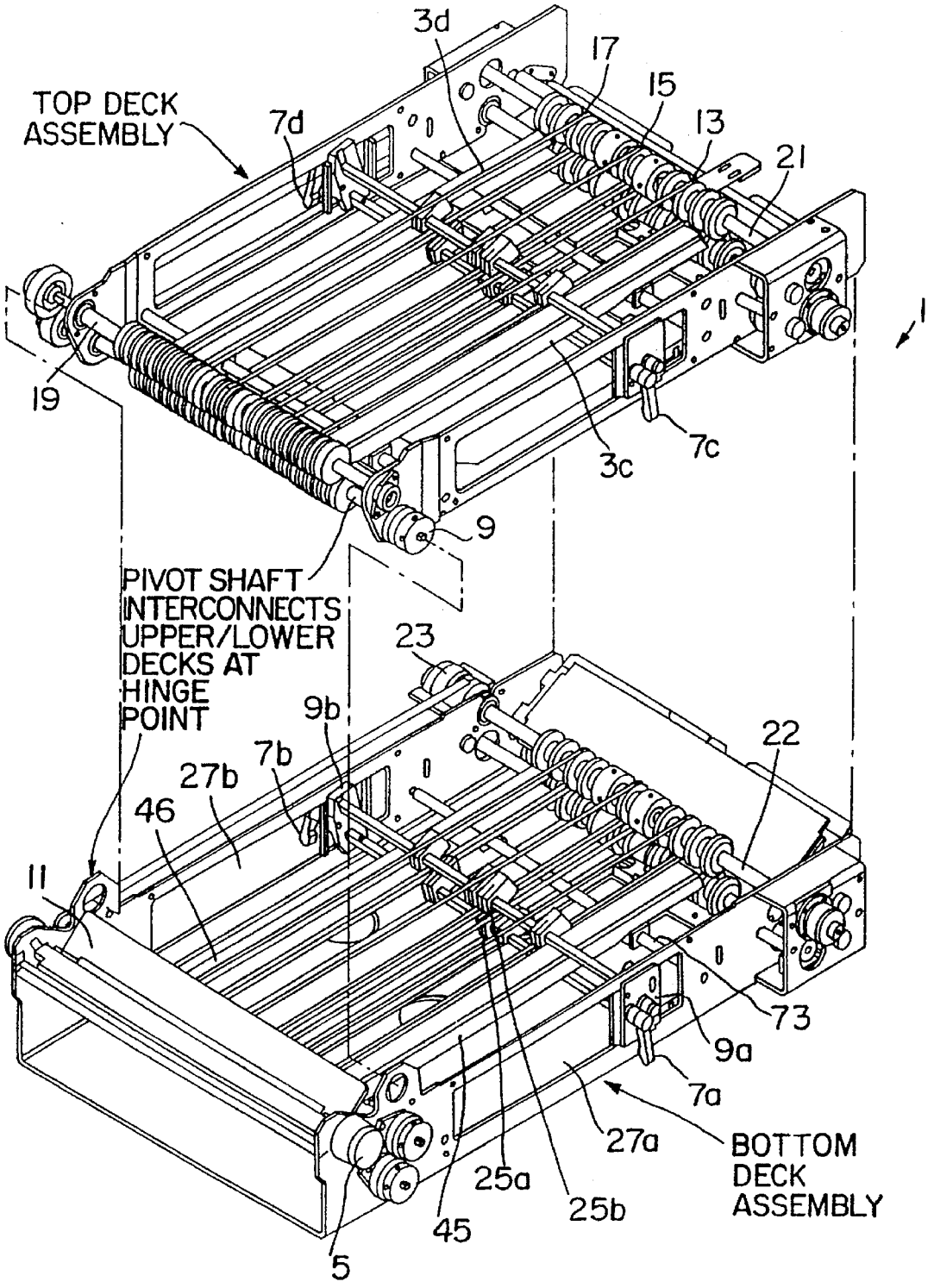
FIG. 1 is a perspective view illustrating the accumulator of the invention.

FIG. 1 illustrates a double-level accumulator 1 having top and bottom deck assemblies and a divert gate 11 for selecting whether documents fed to the accumulator will be received in the lower or upper deck. Deck selection is controlled via operation of the gate solenoid 5 to position the divert gate 1. During steady state operation, the deck selection will normally alternate at each new set.

Each deck comprises an upper and lower belt assembly, with each assembly comprising three belts, e.g., belts 13, 15, and 17, which are retained by three pulleys mounted on respective shafts, e.g., shafts 19 and 21. The belts are preferably the "round" type, also known in the art as "spaghetti belts." Motion of the belts is accomplished via a clutch 23 operably connected to a motor.

Each deck comprises at least two ramps, e.g., 25*a* and 25*b*, for performing over-accumulation and under-accumulation, respectively. Each ramp is mounted on a shaft which is in-turn connected at a first end to a first rotating assembly 9*a* and at a second end to a second rotating assembly 9*b*. Release levers 7*a*, 7*b*, 7*c*, and 7*d* can be operated without the use of tools to permit the rotating assemblies 9*a* and 9*b* to be rotated upwards for over-accumulation or downwards for under-accumulation. When the assemblies 9*a* and 9*b* are rotated upward, the lower ramp 25*a* engages an incoming sheet and directs it upward onto the top of a stack of accumulated documents. When the assemblies 9*a* and 9*b* are rotated downward, the upper ramp 25*b* engages an incoming sheet and directs it downward under a stack of accumulated documents. The rotating assemblies 9*a* and 9*b* are also longitudinally translatable in slots 27*a* and 27*b* to adjust for various paper lengths. Side guides 45, 46, 3*c*, and 3*d* are provided for guiding the outer edges of documents as they are transported through the accumulator. All of the side guides are laterally translatable to adjust for various paper widths.

Figure 2:
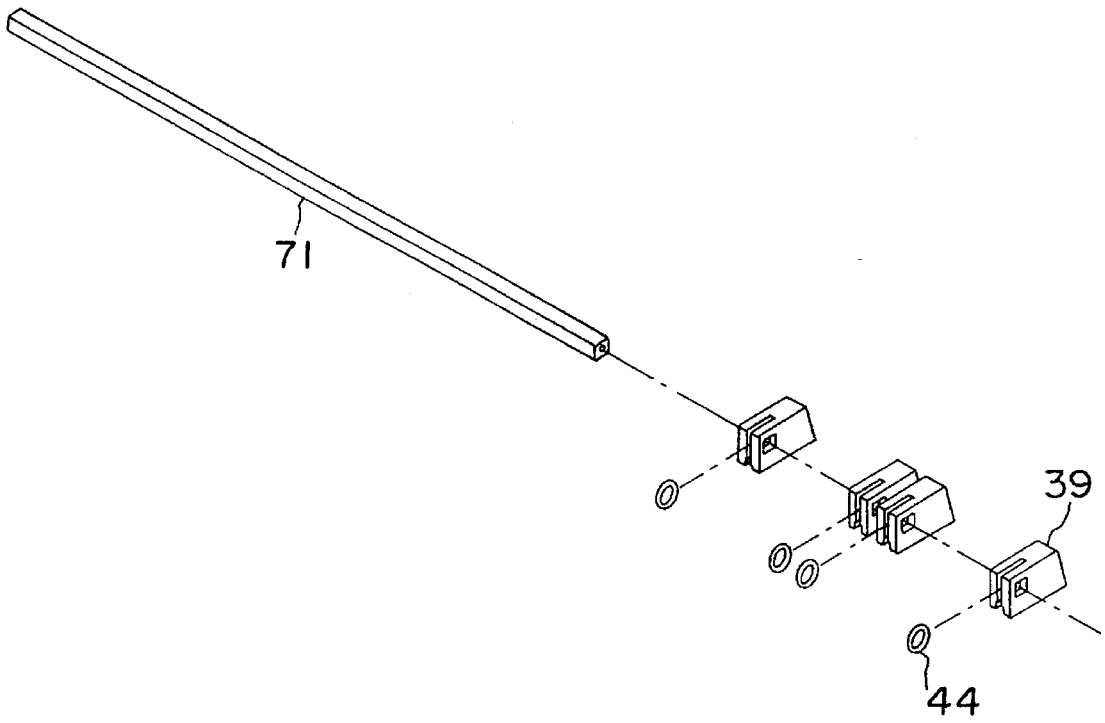
FIG. 2 is a perspective view illustrating the ramps, bars, and O-rings of the invention.

FIG. 2 illustrates the mounting of a ramp 39 to its cross-bar 71. A neoprene rubber O-ring 44 is inserted into the ramp 39 prior to the ramp being mounted onto the cross-bar 71. This permits a ramp to be securely fastened to a cross-bar, via the friction imparted by the O-ring between the ramp and the cross bar, while permiting an operator to translate a side guide along its shafts without the use of tools by first rocking the ramp to one side (thus reducing that friction) and then pushing the ramp inward or outward.

Figure 3:
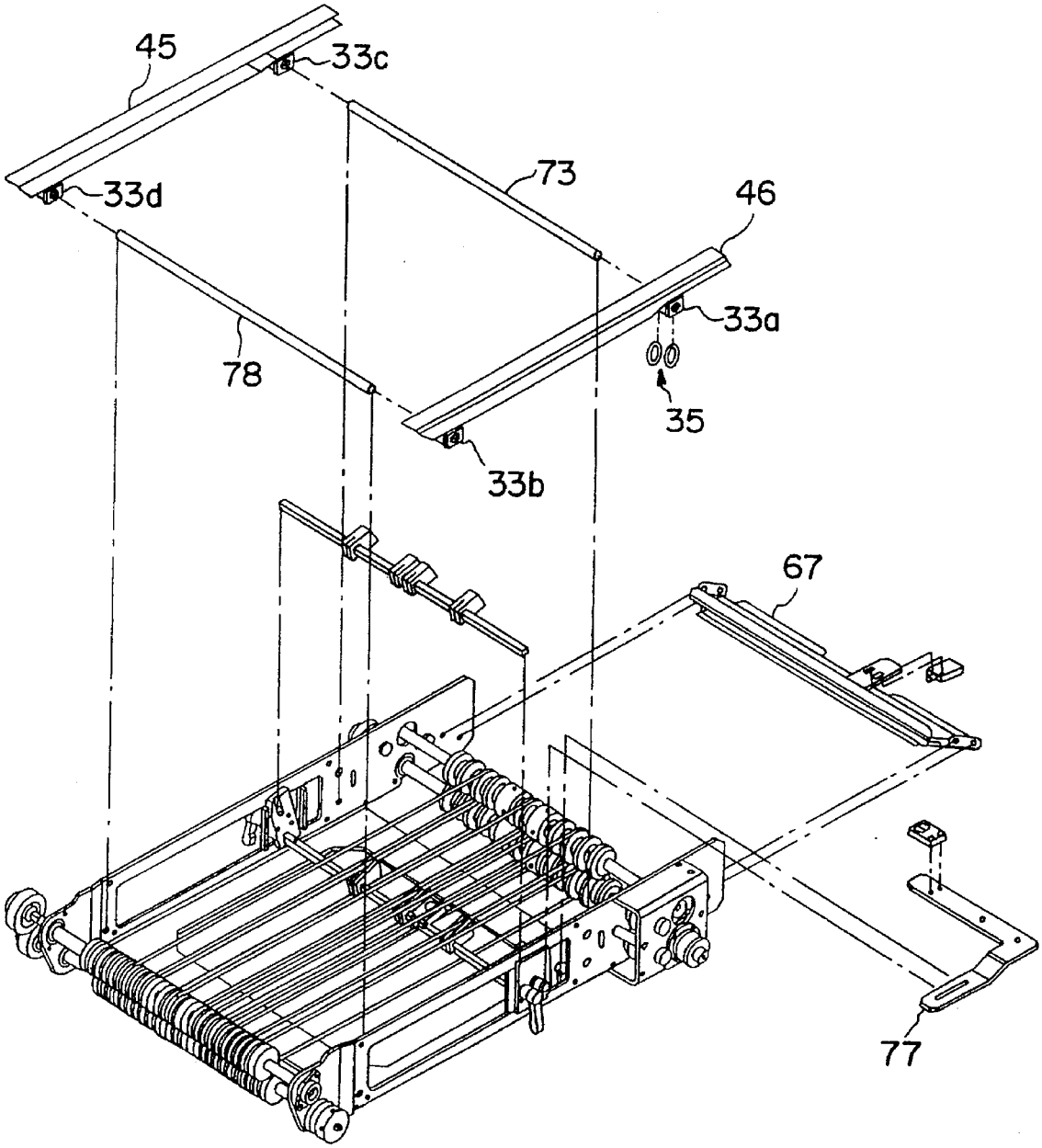
FIG. 3 is a partial perspective view illustrating the side guides, O-rings, and guide rods of the invention.

FIG. 3 illustrates the side guides 45 and 46. The side guides 45 and 46 are connected to shafts 73 and 78 via shaft connectors 33*a*, 33*b*, 33*c*, and 33*d* affixed to the side guides 45 and 46. A pair of neoprene rubber O-rings 35 are inserted into each of the shaft connectors 33*a*, 33*b*, 33*c*, and 33*d* prior to insertion of the shafts into the connectors. This permits the side guides to be securely fastened to the shafts, via friction imparted by the O-rings between the shaft connector and the shaft, while permiting an operator to translate a side guide along its shafts without the use of tools by first rocking it to one side (thus reducing that friction) and then pushing the guide inward or outward.

The pivot shaft shown in FIG. 1, which is a drive shaft for the upper deck, serves also to interconnect the upper and lower decks such that it becomes a hinge point around which the upper deck can be rotated. This facilitates access to the lower deck by releasing and pivoting up the upper deck without the need for a time-consuming deck-removal process.

While the invention has been particularly shown and described with reference to a preferred embodiment thereof, it will be understood by those skilled in the art that various changes in form and details may be made therein without departing from the spirit and scope of the invention.

The embodiments of the invention in which an exclusive property or privilege is claimed are defined as follows:

1. A document accumulator capable of tool-less adjustment to accommodate a plurality of paper sizes, comprising:

at least one cross-bar means laterally oriented across a paper path through said accumulator;

at least one ramp means mounted to said cross-bar means for contacting and guiding documents transported through the accumulator;

at least one connection means for slidably connecting said ramp means to said cross-bar means, said connection means being operatively connected to said ramp means and having a passageway therethrough for receiving said cross-bar means with sufficient clearance to enable said connection means to be rocked about said cross-bar means;

at least one compressible O-ring means inserted between said cross-bar means and said connection means for imparting a first amount of friction therebetween when said connection means is in a first position, and for imparting a second, lower amount of friction therebetween when said connection means is rocked into a second position, whereby said ramp means can be translated along said cross-bar means without the use of a tool.

2. The document accumulator according to claim 1, wherein said cross-bar means comprises a rectangular shaft and said passageway for receiving said cross-bar means is rectangular.

3. The document accumulator according to claim 1, wherein said compressible O-ring means is comprised of neoprene rubber.

4. The document accumulator according to claim 1, further comprising:

at least one side guide means mounted to said cross-bar means for contacting and guiding edges of documents transported through the accumulator;

a second connection means for slidably connecting said side guide means to said cross-bar means;

a second compressible O-ring means inserted-between said cross-bar means and said second connection means for imparting friction therebetween, whereby said side guide means can be translated along said cross-bar means without the use of a tool.

5. The document accumulator according to claim 4, wherein said cross-bar means comprises a cross bar for receiving said first connection means and a shaft for receiving said second connection means.

* * * * *